United States Patent [19]

Yokoyama et al.

[11] 4,374,924

[45] Feb. 22, 1983

[54] ANTISTATIC SILVER HALIDE PHOTOGRAPHIC LIGHT-SENSITIVE MATERIAL

[75] Inventors: Shigeki Yokoyama; Shinzo Kishimoto; Itsuki Toriya; Taku Nakamura, all of Minami-ashigara, Japan

[73] Assignee: Fuji Photo Film Co., Ltd., Kanagawa, Japan

[21] Appl. No.: 351,812

[22] Filed: Feb. 24, 1982

Related U.S. Application Data

[63] Continuation of Ser. No. 87,837, Oct. 24, 1979, abandoned.

[30] Foreign Application Priority Data

Oct. 24, 1978 [JP] Japan ..... 53-130841

[51] Int. Cl.[3] ..... G03C 1/02

[52] U.S. Cl. ..... 430/528; 430/495; 430/631; 430/523; 430/531; 430/539; 430/536

[58] Field of Search ..... 430/528, 527, 518, 495, 430/213, 941, 536, 631, 523, 531, 539

[56] References Cited

U.S. PATENT DOCUMENTS

| | | | |
|---|---|---|---|
| 3,282,699 | 11/1966 | Jones et al. | 430/518 |
| 3,607,345 | 9/1971 | Thomas et al. | 430/528 |
| 3,788,855 | 1/1974 | Cohen et al. | 430/518 |
| 3,958,995 | 5/1976 | Campbell et al. | 430/518 |
| 4,070,189 | 1/1978 | Kelley et al. | 430/527 |
| 4,193,800 | 3/1980 | Iwama et al. | 430/213 |

FOREIGN PATENT DOCUMENTS

| | | | |
|---|---|---|---|
| 1484868 | 9/1977 | United Kingdom | 430/528 |

*Primary Examiner*—Won H. Louie, Jr.
*Attorney, Agent, or Firm*—Sughrue, Mion, Zinn, Macpeak & Seas

[57] ABSTRACT

A silver halide photographic light-sensitive material having at least one antistatic layer, said antistatic layer containing a dispersion of polymer represented by the following formula (I):

wherein A represents a monomer unit formed from a copolymerizable monomer having at least two ethylenically unsaturated groups, B represents a monomer unit formed from a copolymerizable and monoethylenically unsaturated monomer, $R_1$ represents a hydrogen atom or a lower alkyl group having 1 to 6 carbon atoms, Q represents a divalent group containing 1 to 12 carbon atoms, $R_2$, $R_3$ and $R_4$ may be the same or different and each represents an alkyl group containing 1 to 20 carbon atoms, or an aralkyl group containing 7 to 20 carbon atoms, or $R_2$, $R_3$ and $R_4$ may combine to form a ring together with the nitrogen atom, $X^{\ominus}$ represents an anion, x is about 0.25 to 10 mol%, y is about 0 to 90 mol%, and z is about 10 to 99 mol%.

21 Claims, No Drawings

ANTISTATIC SILVER HALIDE PHOTOGRAPHIC LIGHT-SENSITIVE MATERIAL

This is a continuation, of application Ser. No. 87,837, filed Oct. 24, 1979, abandoned.

BACKGROUND OF THE INVENTION

1. Field of the Invention

The present invention relates to an antistatic photographic light-sensitive material and, more particularly, to an antistatic photographic light-sensitive material having at least one light-sensitive silver halide emulsion layer and at least one antistatic layer.

2. Description of the Prior Art

In producing and using photographic light-sensitive materials, static electricity tends to accumulate and causes many troubles. In producing photographic light-sensitive materials, this electrostatic charge is generated due to friction between photographic light-sensitive materials and rollers, friction between the support surface and the emulsion surface, or delamination of the support surface from the emulsion surface upon winding or rewinding photographic light-sensitive materials. Also, in using photographic light-sensitive materials, the electrostatic charge is generated upon delamination of the support from the emulsion surface when a photographic light-sensitive material is exposed to high humidity to cause adhesion of the light-sensitive material, or in the case of automatically developing films for movies or X-ray films. If discharge of the thus accumulated static electricity is accompanied by a light emission the light-sensitive material is exposed and, after development processing, irregular static marks such as stain-like, tree-like, or fur-like marks are formed, which seriously deteriorates the commercial value of photographic light-sensitive materials. These static marks are a quite different problem because their existence cannot be checked before development. In addition, the accumulated static electricity causes dust adhesion onto the surface of a light-sensitive material, which in turn causes secondary problems such as non-uniform coating.

Further, degree of accumulation of static electricity is so great due to hydrophobic properties of all supports for light-sensitive materials that static marks increase with the increase in processing speed and sensitivity of emulsion. Thus, there result seriously detrimental influences.

There have so far been used various materials to prevent charging of photographic light-sensitive materials. Such materials are ionic conductive materials or hygroscopic materials, and they are often used to impart conductivity to light-sensitive materials so as to rapidly remove electrostatic charges before discharge due to accumulation of static electricity takes place. These materials are used alone and in combination.

In order to directly impart antistatic properties to the support of a photographic light-sensitive materials, such materials have been known to be directly incorporated in a support-forming high molecular material or to be coated on the surface of the support. In the latter case, antistatic agents are coated as such or by mixing with a high molecular material such as gelatin, polyvinyl alcohol, cellulose acetate, polyvinyl formal, polyvinyl butyral, or the like. In addition, these antistatic agents may be added to other light-insensitive layers (for example, a backing layer, antihalation layer, interlayer, protective layer, etc.) as well as the light-sensitive emulsion layer provided on the support.

It has also been known to apply the antistatic agent to developed light-sensitive materials so as to prevent dust from adhering to developed light-sensitive materials in handling them.

Of conventionally known antistatic agents, there are few agents which exhibit satisfactory antistatic effects on light-sensitive materials having high sensitive emulsion layers especially under conditions of low humidity, and many agents suffer reduction in antistatic effect with lapse of time and cause adhesion problems under high temperature and high humidity conditions. In some cases they exert detrimental influences on photographic properties.

Thus, application of the antistatic agents to photographic light-sensitive materials has been difficult. For example, some of the polymers having acrylic or methacrylic esters with quaternary ammonium group as polymerization unit described in Japanese Patent Application (OPI) No. 125726/75 (The term "OPI" as used herein refers to a "published unexamined Japanese patent application") (corresponding to U.S. Defensive Publication No. T-955,003) and British Pat. No. 1,484,868 possess fairly good antistatic properties. However, layers coated with such polymers are sticky and tend to adhere to other surfaces and possess less resistance to aqueous compositions for development processing. Thus, they have the defect that scum of light-sensitive material is unavoidable.

On the other hand, the use of cross-linked polymers having as a polymerization unit vinylbenzyl quaternary ammonium as described in Japanese Patent Application (OPI) No. 45231/78 fails to provide a complete antistatic effect although adhesion resistance and prevention of scum during development processing are attained to some extent.

SUMMARY OF THE INVENTION

An object of the present invention is to provide an antistatic silver halide light-sensitive material having a remarkably low surface electric resistance.

Another object of the present invention is to provide an antistatic silver halide light-sensitive material having a good adhesion resistance.

A further object of the present invention is to provide an antistatic silver halide light-sensitive material which does not suffer from scum during development.

Still a further object of the present invention is to provide an antistatic silver halide light-sensitive material which does not exert detrimental influences on photographic properties.

It has been found that a dispersion of a polymer having the units represented by the general formula (I) imparts excellent antistatic properties and attains the above-described objects.

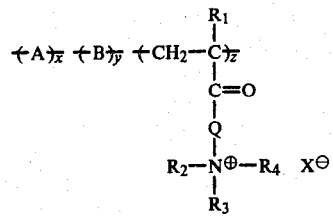

(I)

DETAILED DESCRIPTION OF THE INVENTION

In the above formula, A represents a monomer unit formed from copolymerizable monomers having at least two ethylenically unsaturated groups, B represents a monomer unit formed from a copolymerizable and monoethylenically unsaturated monomer, $R_1$ represents a hydrogen atom or a lower alkyl group having 1 to 6 carbon atoms, Q represents a divalent group containing 1 to 12 carbon atoms, $R_2$, $R_3$ and $R_4$ may be the same or different and each represents an alkyl group containing 1 to 20 carbon atoms, or an aralkyl group containing 7 to 20 carbon atoms, $R_2$, $R_3$, and $R_4$ may combine to form a cyclic structure together with the nitrogen atom, $X^{\ominus}$ represents an anion, x is about 0.25 to 10 mol%, y is 0 to about 90 mol%, and z is about 10 to about 99 mol%.

In a preferred polymer dispersion of the present invention, A in the above general formula represents a monomer unit formed from a copolymerizable monomer having at least two ethylenically unsaturated groups such as a vinyl monomer having the formula of $$(CH_2{=}\overset{\overset{R_5}{|}}{C}{-})_nY$$

wherein n is an integer greater than 1, preferably 2 or 3, $R_5$ represents a hydrogen atom or a methyl group and Y represents one or more linking groups such as an amido group (e.g., an amido group, a sulfonamido group, etc.), an ester group (e.g., a sulfonic acid ester group, a carboxylic acid ester group etc.), an alkylene group (e.g., a methylene group, an ethylene group, a trimethylene group, etc.), an arylene group (e.g., a phenylene group, a phenylene(oxycarbonyl) group, etc.), or the like.

Examples of copolymerizable monomers having at least two ethylenically unsaturated groups include divinylbenzene, ethylene glycol dimethacrylate, isopropylene glycol dimethacrylate, neopentyl glycol dimethacrylate, tetramethylene glycol diacrylate, tetramethylene glycol dimethacrylate, etc. Of these, divinylbenzene and ethylene glycol dimethacrylate are particularly preferred. Furthermore, A in the formula may contain more than one type of monomer unit.

B represents a monomer unit formed from copolymerizable monoethylenically unsaturated monomers. Examples of the monoethylenically unsaturated monomers include α olefins such as ethylene, propylene, 1-butene, isobutene, styrene, α-methylstyrene, vinyltoluene; monoethylenically unsaturated esters of aliphatic acids (e.g., vinyl acetate, allyl acetate, etc.); ethylenically unsaturated mono- or dicarboxylic acid esters and amides (e.g., methyl methacrylate, ethyl acrylate, n-butyl acrylate, n-butyl methacrylate, n-hexyl methacrylate, n-octyl acrylate, benzyl acrylate, cyclohexyl methacrylate, 2-ethylhexyl acrylate, acrylamide, etc.); acrylonitrile; etc. Of these, styrene, methyl methacrylate, ethyl methacrylate, n-butyl methacrylate, cyclohexyl methacrylate, etc., are particularly preferred. B may contain two or more of the above-described monomer units.

$R_1$ represents a hydrogen atom or a lower alkyl group containing 1 to 6 carbon atoms (e.g., a methyl group, an ethyl group, an n-propyl group, an n-butyl group, an n-amyl group, an n-hexyl group, etc.). Of these, a hydrogen atom or a methyl group is particularly preferred.

Q represents a divalent group containing 1 to 12 carbon atoms. Examples thereof include an alkylene group (for example, a methylene group, an ethylene group, a trimethylene group, a $$-CH_2\underset{\underset{OH}{|}}{C}HCH_2-);$$

an arylene group including a phenylene group,

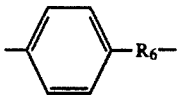

wherein $R_6$ here and below represents an alkylene group containing 1 to about 6 carbon atoms; $-O-R_6-$ such as $-O-CH_2CH_2-$, $-O-CH_2CH_2CH_2-$, or the like;

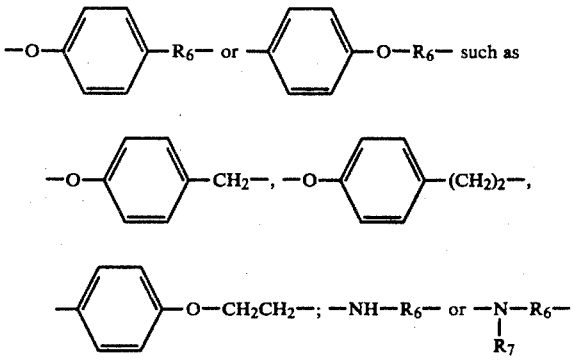

where $R_7$ represents an alkyl group containing 1 to about 6 carbon atoms or an aralkyl group containing 7 to about 20 carbon atoms such as $-NHCH_2CH_2-$ or $-NHCH_2CH_2CH_2-$; and

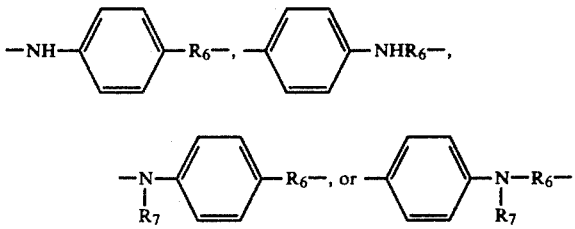

such as

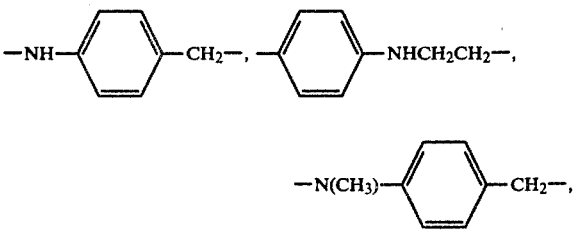

etc. Of these, —O—$R_6$— and —NH—$R_6$— groups such as —O—$CH_2CH_2$—, —$NHCH_2CH_2CH_2$—, etc., are particularly preferred.

$R_2$, $R_3$ and $R_4$ may be the same or different and each represents an alkyl group containing 1 to about 20 carbon atoms or an aralkyl group containing 7 to about 20 carbon atoms, with the alkyl and aralkyl groups including substituted alkyl and substituted aralkyl groups, respectively.

$R_2$, $R_3$ and $R_4$ may be linked to each other to form a ring together with the nitrogen atom which may be a saturated or unsaturated, 5- or 6-membered ring which may contain a hetero atom (e.g., an oxygen, sulfur or nitrogen atom) in addition to the nitrogen atom found in the formula. Preferred rings formed by $R_2$, $R_3$ and $R_4$ include pyridine ring and morpholine ring.

As the alkyl group, there are unsubstituted alkyl groups containing preferably 1 to 10 carbon atoms such as a methyl group, an ethyl group, an n-propyl group, an isopropyl group, an n-butyl group, an isobutyl group, a t-butyl group, an n-amyl group, an isoamyl group, an n-hexyl group, a cyclohexyl group, an n-heptyl group, an n-octyl group, a 2-ethylhexyl group, an n-nonyl group, an n-decyl group, an n-dodecyl group, etc.

As the substituted alkyl group, there are illustrated, for example, an alkoxyalkyl group (e.g., a methoxymethyl group, a methoxyethyl group, a methoxybutyl group, an ethoxyethyl group, an ethoxypropyl group, an ethoxybutyl group, a butoxyethyl group, a butoxypropyl group, a butoxybutyl group, a vinyloxyethyl group, etc.), a cyanoalkyl group (e.g., a 2-cyanoethyl group, a 3-cyanopropyl group, a 4-cyanobutyl group, etc.), a halogenated alkyl group (e.g., a 2-fluoroethyl group, a 2-chloroethyl group, a 3-fluoropropyl group, etc.), an alkoxycarbonylalkyl group (e.g., an ethoxycarbonylmethyl group, etc.), an allyl group, a 2-butenyl group, a propargyl group, etc.

As the aralkyl group, there are unsubstituted aralkyl groups such as a benzyl group, a phenethyl group, a diphenylmethyl group, a naphthylmethyl group, etc.; and substituted aralkyl groups such as an alkylaralkyl group (e.g., a 4-methylbenzyl group, a 2,5-dimethylbenzyl group, a 4-isopropylbenzyl group, etc.), an alkoxyaralkyl group (e.g., a 4-methoxybenzyl group, a 4-ethoxybenzyl group, a 4-(4-methoxyphenyl)benzyl group, etc.), a cyanoaralkyl group (e.g., a 4-cyanobenzyl group, a 4-(4-cyanophenyl)benzyl group, etc.), a perfluoroalkoxyaralkyl group (e.g., a 4-pentafluoropropoxybenzyl group, a 4-undecafluorohexyloxybenzyl group, etc.), a halogenated aralkyl group (e.g., a 4-chlorobenzyl group, a 4-bromobenzyl group, a 3-chlorobenzyl group, a 4-(4-chlorophenyl)benzyl group, a 4-(4-bromophenyl)benzyl group, etc.), and the like. These aralkyl groups preferably contain 7 to 14 carbon atoms.

Examples of $R_2$, $R_3$ and $R_4$ linked to each other to form a ring together with the nitrogen atom include the cyclic structures formed by $R_2$ and $R_3$ such as

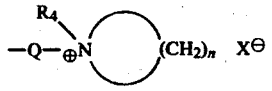

wherein n represents an integer of 4 to 12, and $R_4$ and $X^{\ominus}$ are the same as defined above, and

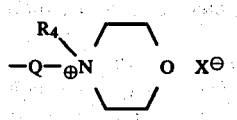

wherein $R_4$ and $X^{\ominus}$ are the same as defined above and the cyclic structures formed by $R_2$, $R_3$ and $R_4$ such as

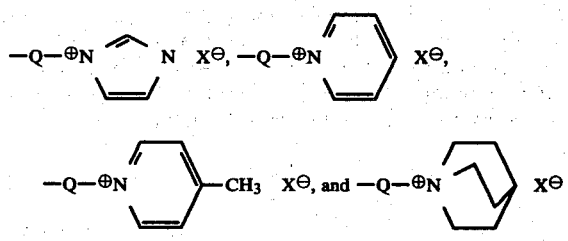

wherein Q and $X^{\ominus}$ are the same as defined above.

$X^{\ominus}$ represents an anion, and examples thereof include halide ions (e.g., a chloride ion, a bromide ion, an iodide ion, etc.), alkylsulfate ions (e.g., a methylsulfate ion, an ethylsulfate ion, etc.), alkyl- or arylsulfonate ions (e.g., a methanesulfonate ion, an ethanesulfonate ion, a benzenesulfonate ion, a p-toluenesulfonate ion, etc.), an acetate ion, a sulfate ion, etc. Of these, a chloride ion is particularly preferred.

x is about 0.25 to about 10 mol%, preferably about 1.0 to about 7.0 mol%, y is 0 to about 90 mol%, preferably 0 to 50 mol%, and z is about 10 to about 99 mol%, preferably about 40 to about 99mol%, more preferably about 50 to about 99 mol%.

The dispersion of polymer of the present invention represented by the following general formula can generally be obtained by emulsion-polymerizing the above-described copolymerizable monomer having at least two ethylenically unsaturated groups, the monoethylenically unsaturated monomer, and an unsaturated monomer represented by the following general formula:

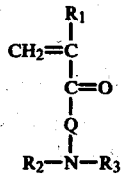

wherein $R_1$, $R_2$, $R_3$ and Q are the same as defined above such as N,N-dimethylaminoethyl methacrylate, N,N-dimethylaminoethyl acrylate, N,N-diethylaminoethyl methacrylate, N,N-diethylaminoethyl acrylate, N-(N,N-diethylaminoethyl)acrylamide, N-(N,N-dimethylaminopropyl)acrylamide, 3-(4-pyridylpropyl) acrylate, N-(N,N-dihexylaminomethyl)acrylamide, N-(N,N-didodecylaminomethyl)acrylamide, preferably N,N-dimethylaminoethyl methacrylate, N,N-diethylaminoethyl methacrylate, or the like. Followed by quaternizing the product with an alkylating or aralkylating agent having the structure of $R_4$-X wherein $R_4$ and X are the same as defined above.

Examples of the alkylating agent include methyl p-toluenesulfonate, dimethylsulfuric acid, diethylsulfuric acid, ethyl bromide, n-propyl bromide, allyl chloride, n-butyl bromide, chloro-2-butene, ethyl chloroacetate, n-hexyl bromide, n-octyl bromide, etc., and examples of the aralkylating agent include benzyl chloride, benzyl bromide, p-nitrobenzyl chloride, p-chlorobenzyl chloride, p-methylbenzyl chloride, p-isopropylbenzyl chloride, dimethylbenzyl chloride, p-methoxybenzyl chloride, p-pentafluoropropenyloxybenzyl chloride, naphthyl chloride, diphenylmethyl chloride, etc., with methyl p-toluenesulfonate, dimethylsulfuric acid, diethylsulfuric acid, and benzyl chloride being preferred.

Also, a dispersion of a polymer of the present invention represented by the general formula (I) can be obtained by emulsion-polymerizing the above-described copolymerizable monomer having at least two ethylenically unsaturated groups, the monoethylenically unsaturated monomer, and an unsaturated monomer represented by the following general formula:

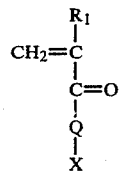

wherein $R_1$, Q and X are the same as defined above. Examples of this monomer are β-chloroethyl methacrylate, β-p-toluenesulfonylethyl methacrylate, chloroacetic acid ester of β-hydroxyethyl acrylate, glycidyl methacrylate, etc. Followed by quaternizing the product with a tertiary amine having structure of

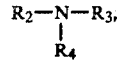

for example, trimethylamine, triethylamine, tri-n-butylamine, tri-n-hexylamine, quinuclidine, pyridine, 4-methylpyridine, etc.

The above-described emulsion-polymerization is generally conducted in water in the presence of at least one surface active agent selected from among anionic surface active agents (for example, those commercially available as "Triton 770" made by Rohm & Haas Co.), cationic surface active agents (for example, cetyltrimethylammonium chloride, stearyltrimethylammonium chloride, etc.), and nonionic surface active agents (for example, polyvinyl alcohol, etc.) and a radical initiator (for example, combination of potassium persulfate and potassium hydrogensulfite).

The above-described quaternizing reaction is generally carried out at temperatures of from 0° C. to about 100° C., particularly preferably 40° C. to 70° C. Production of the polymer dispersion of the present invention can be conducted in one vessel with extreme ease without using much solvent.

Examples of the polymer dispersion of the present invention are illustrated below. (Illustrated polymers contain the following repeating units in the following molar proportions.)

Copolymer 1

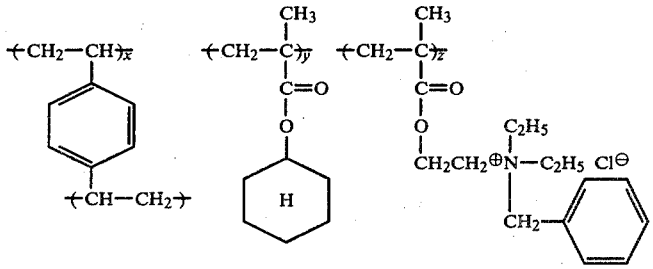

x:y:z = 4:48:48

Copolymer 2

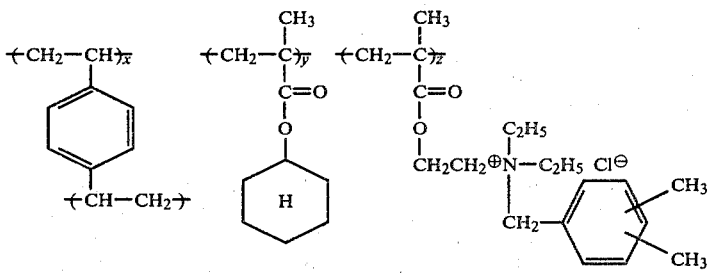

x:y:z = 4:48:48

Copolymer 3

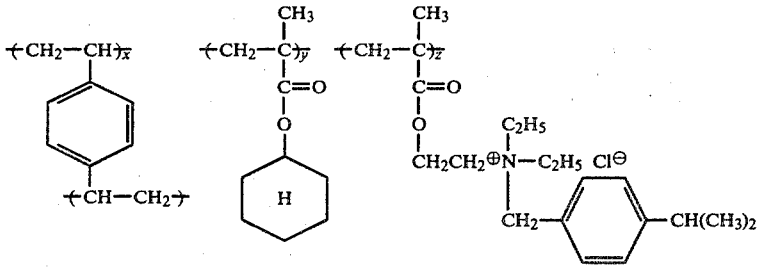

x:y:z = 4:48:48

-continued
Copolymer 4
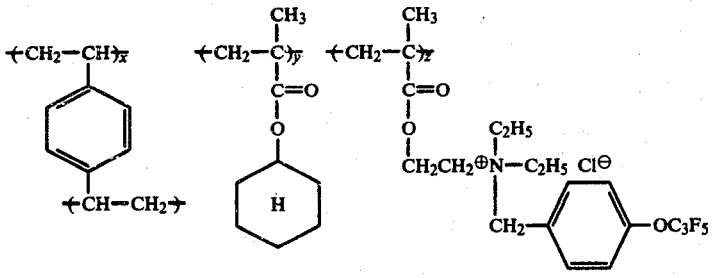
x:y:z = 4:48:48
Copolymer 5
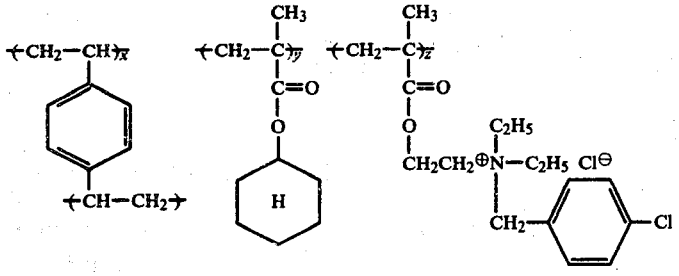
x:y:z = 4:48:48
Copolymer 6
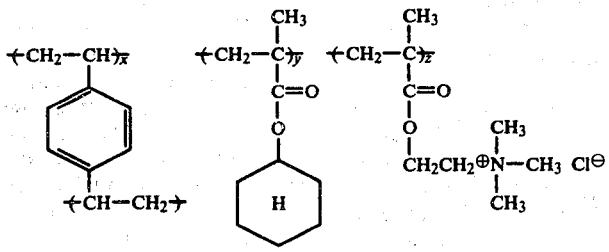
x:y:z = 4:48:48
Copolymer 7
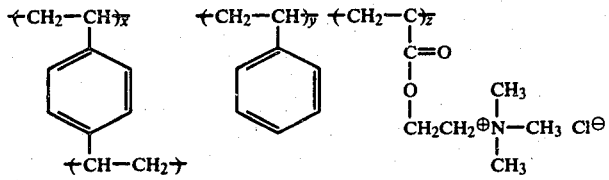
x:y:z = 4:48:48
Copolymer 8
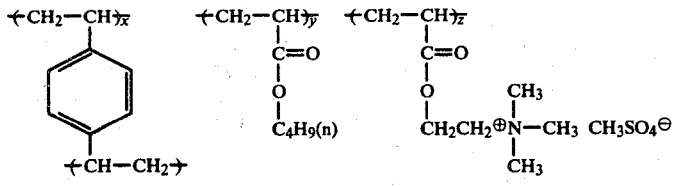
x:y:z = 5:5:95
Copolymer 9
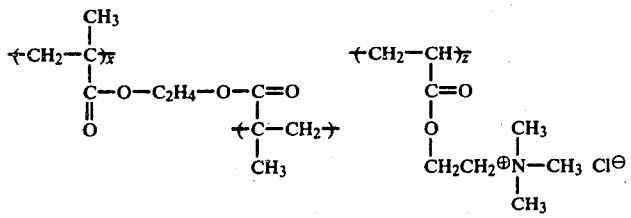
x:z = 7:93

-continued

Copolymer 10

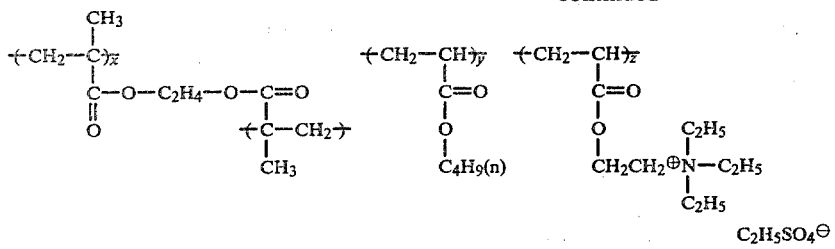

x:y:z = 5:5:95

The coated amount of the dispersion of the present invention varies depending upon the kind and form of the photographic light-sensitive materials, the coating methods, etc. In general, however, the dispersion is used in an amount of about 0.01 to 1.0 g as solids per 1 $m^2$ of the photographic light-sensitive material, with an amount of 0.03 to 0.4 g being particularly preferred.

In applying the polymer dispersion of the present invention to an antistatic layer of a photographic light-sensitive material, it is used as such or by mixing with water or an organic solvent (e.g., methanol, ethanol, acetone, methyl ethyl ketone, ethyl acetate, acetonitrile, dioxane, dimethylformamide, formamide, dimethyl sulfoxide, methyl cellosolve, ethyl cellosolve, etc., with methanol, ethanol, or acetone being particularly preferred) or a mixture thereof, then spraying or coating on the surface of a light-sensitive emulsion layer or a light-insensitive auxiliary layer (e.g., backing layer, antihalation layer, interlayer, protective layer, etc.) provided on the support. It can also be applied to the surface of the support or the layers by dipping in the solution described above.

In addition, the dispersion may be used as an antistatic layer together with photographic binder such as hydrophilic protective colloids and hydrophobic polymers, e.g., gelatin, polyvinyl alcohol, cellulose acetate, cellulose acetate phthalate, polyvinyl formal, polyvinyl butyral, etc.

Application of a fluorine-containing surface active agent or a matting agent to a surface layer containing the dispersion of the present invention provides particularly preferred effects. In particular, the use of fluorine-containing surface active agent is effective for preventing formation of static marks.

Further, the above-described surface layer may contain a hardening agent, lubricant, antihalation dye, etc., for respective purposes.

As matting agents providing preferred effects when used in combination with the present invention, there are illustrated silver halide, barium strontium sulfate, polymethyl methacrylate, methyl methacrylate-methacrylic acid copolymer, colloidal silica, silica dust, etc.

As the fluorine-containing surface active agents there can be illustrated the following compounds: for example, fluorine-containing surface active agents described in British Pat. No. 1,330,356, U.S. Pat. Nos. 3,666,478, 3,589,906, etc. As the typical examples thereof, there are illustrated, for example, N-perfluorooctylsulfonyl-N-propylglycine potassium salt, 2-(N-perfluorooctylsulfonyl-N-ethylamino)ethyl phosphate, N-[4-(perfluorononenyloxy)benzyl]-N,N-dimethylammonioacetate, N-[3-(N',N',N'-trimethylammonio)propyl]perfluorooctylsulfonamide iodide, and N-(polyoxyethylenyl)-N-propylperfluorooctylsulfonamide ($C_8F_{17}SO_2N(C_3H_7)(CH_2CH_2O)_n$).

The polymer dispersion of the present invention may be incorporated in a subbing layer coated between the support and the emulsion layer, a protective layer, a surface layer, and a backing layer on the opposite side of the support to the emulsion layer.

As the support to which the compound of the present invention is applicable, there are illustrated, for example, supports comprising films made of polyolefin (e.g., polyethylene, etc.), polystyrene, cellulose derivative (e.g., cellulose, triacetate, etc.), polyethylene terephthalate, cellulose ester, etc., or sheets prepared by coating both sides of baryta paper, synthetic paper, or the like with these polymer films, and the analogues thereof.

An antihalation layer may be provided on the support used in the present invention. For this purpose, there are used carbon black or various dyes such as oxonol dyes, azo dyes, arylidene dyes, styryl dyes, anthraquinone dyes, merocyanine dyes, tri(or di)arylmethane dyes, etc. As the binder for the carbon black or the dyes, there can be used cellulose mono- or diacetate, polyvinyl alcohol, polyvinyl butyral, polyvinyl acetal, polyvinyl formal, polymethacrylic acid ester, polyacrylic acid ester, polystyrene, styrene/maleic anhydride copolymer, polyvinyl acetate, vinyl acetate/maleic anhydride copolymer, methyl vinyl ether/maleic anhydride copolymer, polyvinylidene chloride, and the derivatives thereof.

As the silver halide light-sensitive materials used in the present invention, there are illustrated various silver halides such as ordinary black-and-white silver halide light-sensitive materials (for example, black-and-white light-sensitive material for photographing, X-ray black-and-white light-sensitive material, black-and-white light-sensitive material for use in printing, etc.), ordinary multilayer color light-sensitive materials (for example, color reversal film, color negative film, color positive film, etc.), and the like. In particular, the present invention is effective when applied to silver halide light-sensitive materials to be processed at high temperature and high speed or to high sensitive silver halide light-sensitive materials.

The present invention will now be described in more detail by the following examples which, however, are not limiting.

SYNTHESIS EXAMPLE 1

Synthesis of poly(divinylbenzene-cyclohexyl methacrylate-N,N-diethylaminoethyl methacrylate) copolymer 216 g of distilled water was placed in a reaction vessel, deaerated with a nitrogen gas, and heated to 60° C. in the presence of the nitrogen gas. 15.8 g of stearyltrimethylammonium chloride, 0.07 g of polyvinyl alcohol, 33.7 g of cyclohexyl methacrylate, 37.1 g of N,N-diethylaminoethyl thacrylate, and 2.0 g of divinylbenzene were added thereto. Then, 0.44 g of potassium persulfate dissolved in 9.3 ml of distilled water deaerated with a nitrogen gas, and 0.14 g of sodium hydrogensulfite dissolved in 1.5 ml of distilled water deaerated with a nitrogen gas were simultaneously added thereto, and heated for about one hour. Subsequently, the above-described potassium persulfate aqueous solution and the sodium hydrogensulfite aqueous solution were again added thereto, followed by continuing heating for about 5 hours. Then, the system was cooled to room temperature, and filtered to obtain a polymer dispersion containing 22.8 wt% solids.

SYNTHESIS EXAMPLE 2

Synthesis of poly(divinylbenzene-cyclohexyl methacrylate-N-(2-methacryloyloxyethyl)-N,N-diethyl-N-benzylammonium chloride) copolymer dispersion 50.0 g of the latex obtained in Synthesis Example 1 and 37.4 ml of distilled water were placed in a reaction vessel. 3.0 g of benzyl chloride was added dropwise thereto in 5 minutes while cooling to about 20° C., and stirring was continued for further 30 minutes. Then, the reaction temperature was raised to 60° C., and the mixture was stirred for about 8 hours. Thereafter, the reaction mixture was cooled to room temperature and filtered to obtain a polymer dispersion of Copolymer 1 containing 14.9 wt% solids.

Additionally, a series of polymer dispersions were synthesized in the same manner as in Synthesis Examples 1 and 2 except for using various alkylating agents for the quaternisation reaction.

EXAMPLE 1

Preparation of samples:

450 g of a mixed solvent containing 55% acetone and 45% methanol was added to each of 50 g (7.5 g as solids) of aqueous dispersions of Copolymers 1 to 10 of the present invention. Each of the resulting dispersions was coated on a cellulose triacetate film in an amount of 100 mg/m$^2$, then dried. An indirect X-ray photographic emulsion containing 9 wt% gelatin and 9 wt% silver halide was coated on the opposite side of each of the thus coated film bases.

Samples prepared by using dispersions of Copolymers 1 to 10 of the present invention are referred to as samples Nos. 1 to 10. Separately, 50 g (7.5 g as solids) of the following dispersion (A) was similarly coated in the same amount to prepare sample No. 11 for comparison.

Also, as a blank, there was prepared sample No. 12 not coated on the opposite side of an emulsion layer.

Comparative Dispersion (A):

An aqueous dispersion of the polymer represented by the following formula in a solid content of 14.6% by weight:

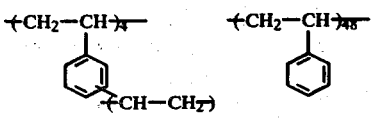

-continued

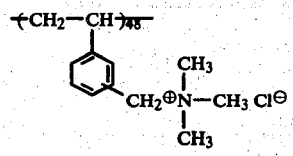

METHOD FOR RATING ANTISTATIC PROPERTIES

Antistatic ability was determined by measuring surface resistance and static marks.

Surface resistance was measured by sandwiching a test piece between 10 cm long brass electrodes (portions in contact with the test piece being made of stainless steel) spaced at a distance of 0.14 cm, and using an insulation resistance tester, model TR8651, made by Takeda Riken Co., Ltd. to obtain one-minute value.

Static marks were measured by placing an unexposed light-sensitive material on a rubber sheet with the antistatic agent-containing surface facing the sheet, pressing the light-sensitive material against the sheet using a rubber roller, then delaminating the light-sensitive material from the sheet to form static marks.

As to measuring conditions, surface resistance was measured at 25° C. under 25% RH, and static mark-generation was conducted at 25° C. under 25% RH. Additionally, test pieces of samples which had been subjected to moisture conditioning for one day and one night under the aforesaid conditions were tested.

In order to rate the degree of generation of static marks, each sample was development processed for 5 minutes at 20° C. using the developer of the following composition.

| Developer Composition: | |
|---|---|
| N—Methyl-p-aminophenol Sulfate | 4 g |
| Anhydrous Sodium Sulfite | 60 g |
| Hydroquinone | 10 g |
| Sodium Carbonate (monohydrate) | 53 g |
| Potassium Bromide | 25 g |
| Water to make | 1 l |

Rating of static marks was conducted according to the following five grades.

A: No static marks were observed.

B: Static marks were slightly observed.

C: Static marks were considerably observed.

D: Static marks were seriously observed.

E: Static marks were observed all over the surface.

Surface resistance of the back side of each sample film and degree of static marks thus obtained are tabulated in Table 1.

TABLE 1

| Sample No. | Antistatic Agent | Surface Resistance (Ω) | Static Marks |
|---|---|---|---|
| 1 | Copolymer 1 | $1.5 \times 10^{10}$ | A |
| 2 | Copolymer 2 | $5.8 \times 10^{10}$ | A-B |
| 3 | Copolymer 3 | $1.4 \times 10^{10}$ | A-B |
| 4 | Copolymer 4 | $2.3 \times 10^{10}$ | A |
| 5 | Copolymer 5 | $3.4 \times 10^{10}$ | A |
| 6 | Copolymer 6 | $4.8 \times 10^{10}$ | A-B |
| 7 | Copolymer 7 | $1.3 \times 10^{10}$ | A |
| 8 | Copolymer 8 | $7.5 \times 10^{9}$ | A |
| 9 | Copolymer 9 | $4.5 \times 10^{9}$ | A |
| 10 | Copolymer 10 | $8.1 \times 10^{9}$ | A |
| 11 | Comparative | $4.3 \times 10^{11}$ | C |

TABLE 1-continued

| Sample No. | Antistatic Agent | Surface Resistance (Ω) | Static Marks |
|---|---|---|---|
| 12 | Dispersion (A) Blank | above $10^{15}$ | E |

As is clear from Table 1, samples 1 to 10 having the antistatic layer (backing layer) comprising the polymer dispersion of the present invention showed less surface resistance and formed almost no static marks. On the other hand, sample 11 having the backing layer comprising comparative dispersion (A) showed a high surface resistance and was liable to form static marks.

EXAMPLE 2

Preparation of samples:

Dispersions of copolymers 1 to 10 of the present invention and a photographic emulsion were coated on cellulose triacetate in the same manner as in Example 1 to prepare samples Nos. 1 to 10.

Separately, a comparative sample (sample No. 13) was prepared by coating compound (B) in the same amount. Compound (B) was a polymer represented by the following formula. Comparative compound (B):

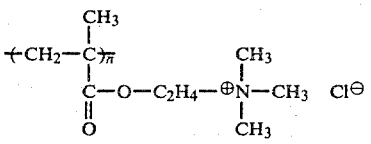

These samples were cut into 3.5×3.5 cm pieces and subjected to adhesion test by superposing one over the other with the emulsion surface facing back surface.

The pieces were brought into contact with each other with the emulsion surface facing back surface, and subjected to a previous humidity conditioning step for 2 days under the atmosphere of 80% RH and 35° C.

(1) The superposed pieces were left for 72 hours at 35° C. under 80% RH with a 500 g of load being applied to them.

(2) The superposed pieces were left for 24 hours at 40° C. under 90% RH with a 1 kg load being applied to them.

Then, the emulsion surface of one sample was delaminated from the back surface of another in both (1) and (2) to measure the adhesion marks of back surface left on the emulsion surface. Since the areas in which the back surface remained were smooth, there results a difference in gloss between these areas and the areas in which the back surface does not remain and hence adhesion marks can be clearly discriminated through reflected light. Adhesion area ratio was presented as $$\frac{\text{adhesion mark area}}{\text{total area}} \times 100\ (\%)$$

The results thus obtained are shown in Table 2.

TABLE 2

| Sample No. | Antistatic Agent | Adhesion Resistance |
|---|---|---|
| 1 | Copolymer 1 | A |
| 2 | Copolymer 2 | B |
| 3 | Copolymer 3 | B |
| 4 | Copolymer 4 | A |
| 5 | Copolymer 5 | A |

TABLE 2-continued

| Sample No. | Antistatic Agent | Adhesion Resistance |
|---|---|---|
| 6 | Copolymer 6 | B |
| 7 | Copolymer 7 | B |
| 8 | Copolymer 8 | B |
| 9 | Copolymer 9 | B |
| 10 | Copolymer 10 | B |
| 13 | Comparative Compound (B) | D |

In the above table, A indicates that the adhesion area ratio was 0–30%, B 31–60%, C 61–80%, and D above 80% or too strongly adhering to delaminate.

As is clear from Table 2, samples 1 to 10 having the antistatic layer (backing layer) comprising the polymer dispersion of the present invention caused no adhesion between the emulsion-coated surface and the back surface, whereas sample 13 having the backing layer comprising comparative compound (B) tended to cause adhesion between the emulsion layer and the backing layer and was practically non-usable.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material having at least one antistatic layer of low surface electric resistance, good adhesion and which does not suffer from scum during development as an outermost backing layer, said antistatic layer containing a dispersion of a polymer represented by the following formula (I):

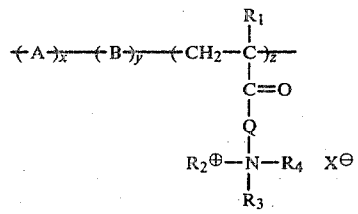

(I)

wherein A represents a monomer unit formed from a copolymerizable monomer having at least two ethylenically unsaturated groups, B represents a monomer unit formed from a copolymerizable and monethylenically unsaturated monomer, $R_1$ represents a hydrogen atom or a lower alkyl group having 1 to 6 carbon atoms, Q represents a divalent group containing 1 to 12 carbon atoms, wherein Q is selected from the class consisting of —O—$R_6$ and —NH—$R_6$—, wherein $R_6$ is an alkylene group containing 1 to 6 carbon atoms, $R_2$, $R_3$ and $R_4$ may be the same or different and each represents an alkyl group containing 1 to 20 carbon atoms, or an aralkyl group containing 7 to 20 carbon atoms, or $R_2$, $R_3$ and $R_4$ may combine to form a ring together with the nitrogen atom, $X^{\ominus}$ represents an anion, x is about 0.25 to 10 mol%, y is about 0 to 90 mol%, and z is about 10 to 99 mol%.

2. The silver halide photographic light-sensitive material of claim 1, wherein $R_1$ represents a hydrogen atom or a methyl group.

3. The silver halide photographic light-sensitive material of claim 1, wherein A represents a monomer unit formed from divinylbenzene or ethylene glycol dimethacrylate.

4. The silver halide photographic light-sensitive material of claim 1, wherein B represents a monomer unit formed from styrene or cyclohexyl methacrylate.

5. The silver halide photographic light-sensitive material of claim 1, wherein the layer containing said polymer dispersion is a backing layer.

6. The silver halide photographic light-sensitive material of claim 1, wherein the layer containing said polymer dispersion overcoats a silver halide emulsion layer.

7. The silver halide photographic light-sensitive material of claim 1, wherein said dispersion is coated in an amount of about 0.01 to 1.0 g/m$^2$ as solids.

8. The silver halide photographic light-sensitive material of claim 1, wherein A is derived from a monomer of the formula:

$$(CH_2{=}\overset{R_2}{\overset{|}{C}})_n{-}Y$$

wherein n is 2 to 3 and Y is a linking group.

9. The silver halide photographic light-sensitive material of claim 1, wherein A is formed from a monomer selected from the group consisting of divinylbenzene, ethylene glycol dimethacrylate, isopropylene glycol dimethacrylate, neopentyl glycol dimethacrylate, tetramethylene glycol diacrylate and tetramethylene glycol dimethacrylate.

10. The silver halide photographic light-sensitive material of claim 1, wherein B is a monomer unit formed from an α-olefin, monoethylenically unsaturated esters of aliphatic acid, ethylenically unsaturated mono- or dicarboxylic acid esters and amides, or acrylonitrile.

11. The silver halide photographic light-sensitive material of claim 1, wherein B is formed from styrene, methyl methacrylate, ethyl methacrylate, n-butyl methacrylate or cyclohexyl methacrylate.

12. The silver halide photographic light-sensitive material of claim 1, wherein $X^-$ represents a halide ion, an alkylsulfate ion, an alkyl or aryl sulfonate ion, an acetate ion, or a sulfate ion.

13. The silver halide photographic light-sensitive material of claim 1, wherein $X^-$ represents a chloride ion.

14. The silver halide photographic light-sensitive material of claim 1, wherein x is about 1 to 7 mol%, y is about 0 to 50 mol% and z is about 40 to 99 mol%.

15. The silver halide photographic light-sensitive material of claim 1, wherein said antistatic layer additionally contains a binder selected from the group consisting of gelatin, polyvinyl alcohol, cellulose acetate, cellulose acetate phthalate, polyvinyl formal and polyvinyl butyral.

16. The silver halide photographic light-sensitive material of claim 1, wherein said antistatic layer additionally contains a fluorine-containing surface active agent.

17. The silver halide photographic light-sensitive material of claim 1, wherein said antistatic layer contains a matting agent.

18. The silver halide light-sensitive material of claim 1, wherein said polymer is selected from the group consisting of copolymers 1–10:

Copolymer 1

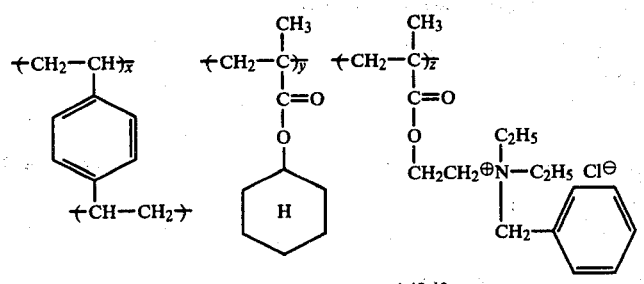

x:y:z = 4:48:48

Copolymer 2

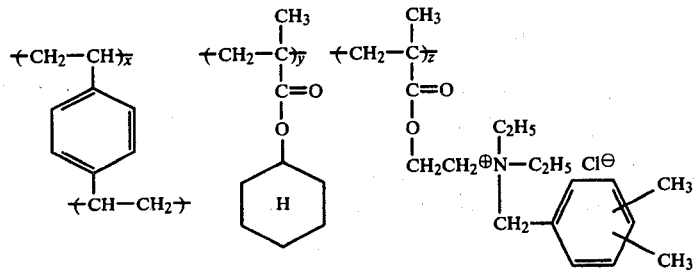

x:y:z = 4:48:48

Copolymer 3

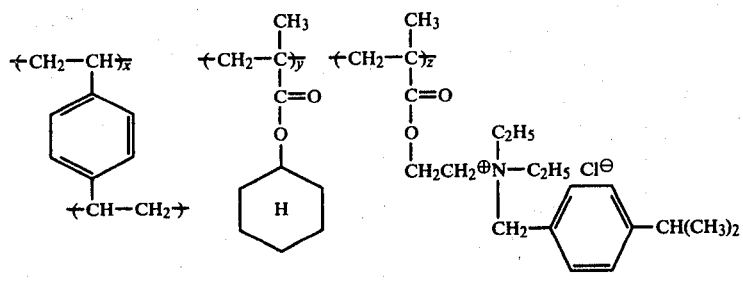

-continued
x:y:z = 4:48:48
Copolymer 4
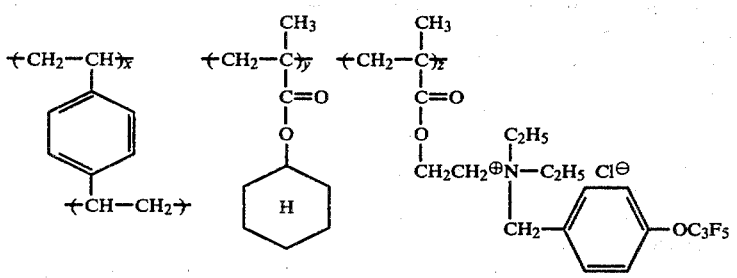
x:y:z = 4:48:48
Copolymer 5
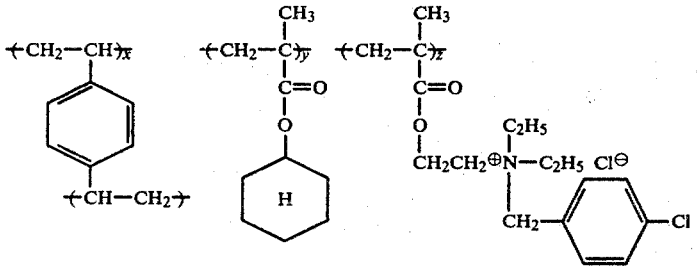
x:y:z = 4:48:48
Copolymer 6
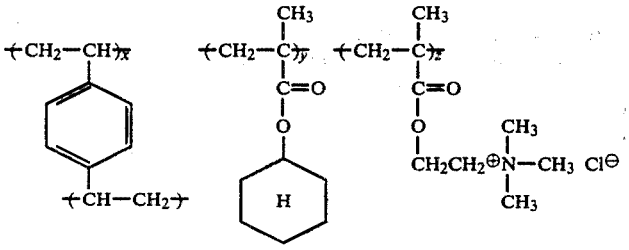
x:y:z = 4:48:48
Copolymer 7
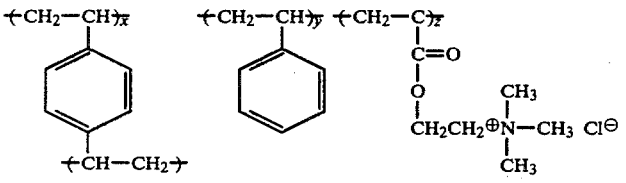
x:y:z = 4:48:48
Copolymer 8
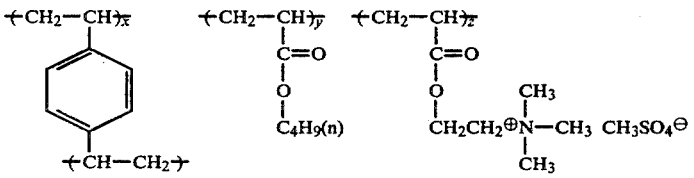
x:y:z = 5:5:95
Copolymer 9
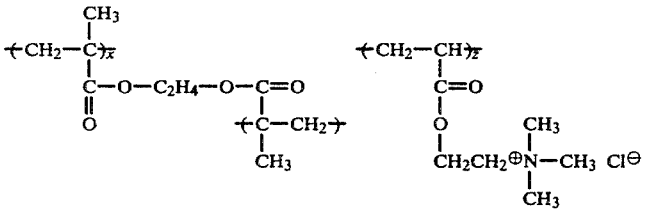
x:z = 7:93 and -continued
Copolymer 10
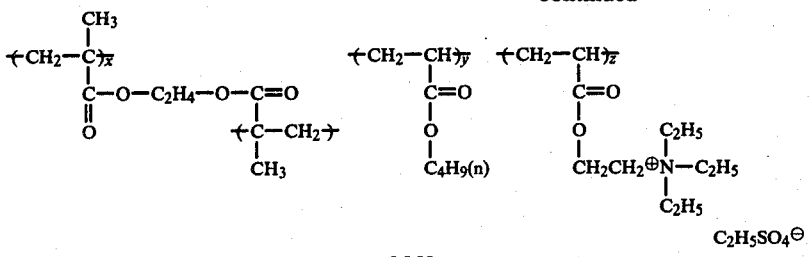
x:y:z = 5:5:95
19. The silver halide light-sensitive material of claim 1, wherein said backing layer is on the side of the support opposite any emulsion layer.
20. The silver halide photographic light-sensitive material of claim 1, wherein Q is —O—$R_6$—.
21. The silver halide photographic light-sensitive material of claim 1, wherein Q is —NH—$R_6$—.
* * * * *